US009555530B2

(12) United States Patent
Pedicini et al.

(10) Patent No.: US 9,555,530 B2
(45) Date of Patent: Jan. 31, 2017

(54) FASTENER DRIVING APPARATUS

(71) Applicants: Christopher Pedicini, Nashville, TN (US); John Witzigreuter, Canton, GA (US)

(72) Inventors: Christopher Pedicini, Nashville, TN (US); John Witzigreuter, Canton, GA (US)

(73) Assignee: Tricord Solutions, Inc., Franklin, TN (US)

( * ) Notice: Subject to any disclaimer, the term of this patent is extended or adjusted under 35 U.S.C. 154(b) by 389 days.

(21) Appl. No.: 14/286,626

(22) Filed: May 23, 2014

(65) Prior Publication Data

US 2015/0336253 A1 Nov. 26, 2015

Related U.S. Application Data

(63) Continuation-in-part of application No. 13/922,465, filed on Jun. 20, 2013, now Pat. No. 8,733,610.

(60) Provisional application No. 61/914,230, filed on Dec. 10, 2013, provisional application No. 61/991,397, filed on May 9, 2014.

(51) Int. Cl.

| | |
|---|---|
| ***B21J 15/28*** | (2006.01) |
| ***B27F 7/17*** | (2006.01) |
| ***B25C 1/06*** | (2006.01) |
| ***B25C 5/15*** | (2006.01) |

(52) U.S. Cl.

CPC .. *B25C 1/06* (2013.01); *B25C 5/15* (2013.01)

(58) Field of Classification Search

CPC ..... B25D 17/06; B25D 11/125; B25C 1/04; B25C 1/06; B25C 1/08; B25C 5/15

USPC ..... 227/30–131, 2, 7–8; 173/1–11, 114, 117, 173/118, 201–204, 121, 212, 76, 132, 48, 173/104, 109, 217

See application file for complete search history.

(56) References Cited

U.S. PATENT DOCUMENTS

| | | | | |
|---|---|---|---|---|
| 6,499,643 | B1 * | 12/2002 | Hewitt | B25C 1/003 173/201 |
| 7,793,811 | B1 * | 9/2010 | Pedicini | B25C 1/047 227/130 |
| 8,079,504 | B1 * | 12/2011 | Pedicini | B25C 1/04 227/130 |
| 8,534,377 | B2 * | 9/2013 | Berger | B25D 11/064 173/121 |
| 2010/0032468 | A1 * | 2/2010 | Gross | B25C 1/06 227/131 |
| 2012/0286014 | A1 * | 11/2012 | Pedicini | B25C 1/06 227/4 |
| 2014/0054350 | A1 * | 2/2014 | Pedicini | B25C 5/15 227/8 |

* cited by examiner

*Primary Examiner* — Robert Long

(74) *Attorney, Agent, or Firm* — Jay Schloff; Aidenbaum Schloff and and Bloom PLLC

(57) ABSTRACT

A fastener driving apparatus includes an extensible polymer assembly and a fastener drive assembly, such that when said extensible polymer assembly is actuated (by a motor and linear motion converter), energy is stored as an extensible polymer of the polymer assembly extends in length and force from said extensible polymer is applied on said fastener drive assembly. When said extensible polymer reaches a sufficient extension, a retention means releases said fastener drive assembly and wherein said fastener drive assembly moves from a first position to a second position such that an anvil of the fastener drive assembly is capable of driving a fastener into a substrate.

20 Claims, 7 Drawing Sheets

Fatigue life versus temperature for test pieces of natural rubber and SBR stretched repeatedly to 175% extension [23].

FASTENER DRIVING APPARATUS

CROSS-REFERENCE TO RELATED APPLICATIONS

The present disclosure is a continuation-in-part of U.S. Non-provisional Patent Application Ser. No. 13/922,465, filed on Jun. 20, 2013 and also claims priority under 35 U.S.C. §119 on U.S. Provisional Application Ser. Nos. 61/914,230, filed on Dec. 10, 2013 and 61/991,397, filed on May 9, 2014, the disclosures of which are incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive then a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those which use a ratcheting spring system such as the Ryobi™ electric stapler). These units are limited to short fasteners (typically 1" or less), are subject to high reactionary forces on the user and are limited in their repetition rate.

The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners which is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train which increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy which can be stored into the air stream. In order to provide sufficient energy in the air stream to achieve good performance, this patent teaches use of a gas supply which preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally, U.S. Pat. No. 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear.

A third means for driving a fastener that is taught includes the use of flywheels as energy storage means. The flywheels are used to launch a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in the present inventors' U.S. Pat. No. 8,079,504, which uses a compression on demand system with a magnetic detent. This system overcomes many of the advantages of the previous systems but still has its own set of disadvantages which include the need to retain a very high pressure for a short period of time. This pressure and subsequent force necessitate the use of high strength components and more expensive batteries and motors.

A fifth means is taught in U.S. patent application Ser. No. 13/922,465, which uses a vacuum to drive a fastener drive assembly. This clearly has its own advantages over the previous systems but has its own set of disadvantages, including the need to retain a seal against air pressure. This sealing requirement necessitates the use of more accurate cylinders and pistons, thus contributing to the manufacturing cost.

All of the currently available devices suffer from one or more the following disadvantages:

Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.

Poor ergonomics. The fuel powered mechanisms have loud combustion reports and combustion fumes. The multiple impact devices are fatiguing and are noisy.

Non-portability. Traditional fastener guns are tethered to a fixed compressor and thus must maintain a separate supply line.

High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.

Safety issues. The "air spring" and heavy spring driven designs suffer from safety issues for longer fasteners since the predisposition of the anvil is towards the substrate. During jam clearing, this can cause the anvil to strike the operators hand.

The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE INVENTION

In accordance with the present invention, a fastener driving apparatus is described which derives its power from an electrical source, preferably rechargeable batteries, and uses a motor to store energy in an extensible polymer assembly comprising an extensible polymer) in a single linear stroke. The extensible polymer acts on a fastener drive assembly, which assembly is detained by a retention device until sufficient energy is stored in the extensible polymer. The fastener drive assembly comprises an anvil. Once the energy stored is sufficient for driving the fastener, the retention mechanism can release, allowing the potential energy stored in the extended or stretched polymer to convert to kinetic energy in the fastener drive assembly, which fastener drive assembly drives the fastener into a substrate. The extensible polymer assembly is then preferably returned to its start (or unextended) position and the fastener drive assembly is likewise returned to its starting position. By using a polymer instead of vacuum or pressure, the inventors improved the simplicity of the fastener drive device by eliminating all of the seals. The overall efficiency unexpectedly remains high notwithstanding the elimination of such seals due to the efficient storage and release of potential energy in the extensible polymer.

The fastener driving cycle of the apparatus disclosed herein may start with an electrical signal, after which a circuit connects a motor to the electrical power source. The motor is coupled to a linear motion converter, preferably through a speed reduction mechanism. In an embodiment, the speed reduction mechanism is a planetary gearbox. The linear motion converter changes the rotational motion of the motor into linear translating movement of extensible polymer assembly (which includes an activator assembly portion). The activator assembly is operatively coupled to the extensible polymer assembly The movement of this activator assembly causes energy to be stored in the polymer by extending the length of the polymer. The extensible polymer of the extensible polymer assembly, as used herein, may be any polymer that has a recoverable strain energy of at least 50%, including, but not necessarily limited to. elastomers and rubbers such as isoprene, nitrile, silicones, urethanes and fluoroelastomers. Upon storage of sufficient energy the fastener drive assembly may release from its retention means. (It will be apparent that the fastener drive assembly may be released from the retention means through means other than the force exerted on the fastener drive assembly by the extensible polymer, including such means as by deactivating the retention means either mechanically through a trip system or electrically by deactivating a solenoid or electromagnet.) The force from the extensible polymer acts on the fastener drive assembly and pulls the fastener drive assembly towards the fastener and substrate, whereby the fastener drive assembly thereafter drives a fastener. The exemplary cycle completes with the extensible polymer assembly and activator assembly substantially returning to a previous or initial position. The fastener drive assembly may be predisposed to its initial position via contact with the extensible energy storage system. By returning the fastener drive assembly in this fashion, virtually all of the recoverable energy from the extensible polymer is available to drive the fastener. Additionally, in the event of a jam, the return movement resets the fastener drive assembly allowing for easy clearing of the jam. Bumpers may be provided to absorb excess energy at the ends of the fastener drive stroke for example. Control of the device is possible through a very simple circuit that applies and removes power to the motor to complete a cycle.

In an embodiment, the extensible polymer assembly and the fastener drive assembly share a common guide structure such as a cylinder, which configuration simplifies the design as only a single guide assembly is needed. Additionally, the movement of the extensible polymer assembly and associated mounting and coupling components can actuate the fastener drive assembly and anvil back into an initial position.

In an embodiment, the retention means is preferably a combination of at least one magnet and a mechanical release means. The fastener drive assembly is preferably released from the retention force as the extensible polymer assembly is at or near the point of maximum energy storage, thus allowing the fastener drive assembly to drive the fastener.

In an embodiment, the fastener drive assembly mass is less than 25% of the tool mass to reduce the recoil felt by the operator and increase the energy delivered to the fastener.

In an embodiment the weight of the extensible polymer is less than 30% of the weight of the fastener drive assembly.

In an embodiment, the drag force on the fastener drive assembly is minimized by using low friction materials along the guide structure to reduce the parasitic energy loss caused by friction during the drive cycle.

In an embodiment, a sensor and a control circuit are provided for determining at least one position of the extensible polymer assembly and thus enable the proper timing for stopping the cycle or, in the case of an electrically-activated detent, timing the release of such detent.

In an embodiment, a mechanical element is used such that as the extensible polymer assembly approaches the point of maximum energy storage, the mechanical element releases the fastener drive assembly from the retention means.

In another embodiment, the latency (which is defined as the time between the user calling for a fastener to be delivered and the actual delivery of the fastener) is reduced. In a preferred embodiment a clutch can be used to reduce this time. In a more preferred embodiment, some or most of the extension (or stretch) of the polymer of the polymer assembly is done prior to the operator requesting a fastener, thus reducing the latency time.

In another embodiment a fan is provided, which fan can be used to cool the extensible polymer by creating convective air flow around the polymer thus increasing the cycle rate and reducing thermal degradation.

Accordingly, and in addition to the objects and advantages of the portable electric fastener gun as described above, several objects and advantages of the present invention are:

To provide a simple design for driving fasteners that has a significantly lower production cost than currently available nail guns and that is portable and does not require an air compressor.

To provide a fastener driving device that mimics the pneumatic fastener performance without a tethered air compressor.

To provide an electrical driven high power fastening device that has very little wear.

To provide an electric motor driven fastener driving device in which energy is not stored behind the fastener driving anvil, thus greatly enhancing tool safety.

To provide a simple apparatus for driving a fastener in which sufficient energy to drive the fastener is created in a single stroke, thus greatly increasing the system efficiency.

To eliminate bungee, vacuum or mechanical spring returns on the fastener drive assembly and/or anvil thus increasing energy available to drive the fastener and speed at which the drive takes place.

To provide a more energy efficient mechanism for driving nails than is presently achievable with a compressed air design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

Figure 1:
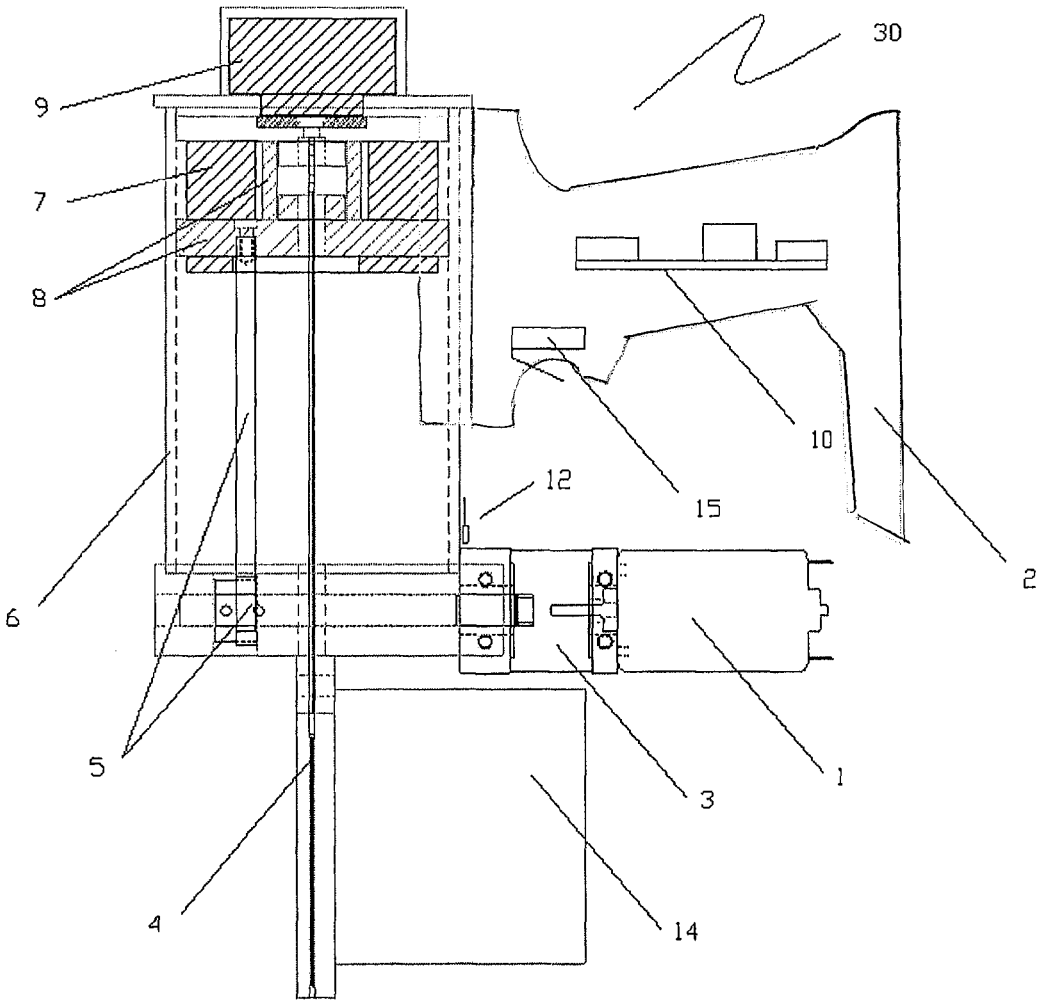
FIG. 1 shows a cutaway view of a fastener driving apparatus, in accordance with an exemplary embodiment of the present disclosure.

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

The present disclosure provides for a fastener driving apparatus. In an embodiment, the apparatus comprises a power source, a control circuit, a motor, an extensible polymer assembly, a linear motion converter, a fastener drive assembly, an anvil, a retention means, and a guide structure. The extensible polymer assembly further comprises an extensible polymer and coupling means to connect to the linear motion converter and to the fastener drive assembly. The fastener drive assembly includes at least one of an anvil and a means to couple said anvil to the extensible polymer assembly. The power source provides power to the control circuit and to the motor, which motor is responsive to the control circuit. The linear motion converter is coupled to the motor and to the extensible polymer assembly, and uses the motion generated by the motor to actuate and store energy in the extensible polymer assembly. The extensible polymer assembly and the fastener drive assembly are each disposed within the guide structure which structure, in a preferred embodiment can be cylindrically shaped. The fastener drive assembly is held in place by the retention means, and the anvil and extensible polymer assembly are coupled to the fastener drive assembly. The extensible polymer assembly is capable of storing energy which upon sufficient storage, may cause the fastener drive assembly to be released from the retention means such that the anvil is capable of driving a fastener into a substrate. As used herein, extensible polymer assembly refers to an assembly in which a polymer stores energy by being stretched to at an engineering strain of at least 0.75 and which upon being released can release at least 50% of such stored energy in a time of less than 30 milliseconds and which recovers in less than 2 seconds to within 110% of its pre-stretched length.

In an embodiment, the fastener drive assembly may be released from the retention means by deactivating an electromagnet, where the electromagnet is the retention means. The apparatus may additionally comprise at least one sensor for detecting a position of each of the extensible polymer assembly and the fastener drive assembly and directing the control circuit to accordingly activate or deactivate the motor or power source based on such positioning.

The apparatus may further comprise at least one bumper, at least one intermediate stoppage point for the extensible polymer assembly, at least one low friction guide bushing and a mechanical element. The at least one bumper is disposed between the extensible polymer assembly and the fastener drive assembly, absorbs any energy remaining within the fastener drive assembly, after the anvil drives the fastener, and may prevent damage to the extensible polymer assembly and fastener drive assembly that may otherwise result from such components coming into contact with one another. The at least one intermediate stoppage point for the extensible polymer assembly can be used to allow the fastener driving apparatus to stop mid-cycle and reduce the latency time. The latency is defined herein to be the time between the user-controlled event which is to drive a fastener (such as the user pressing a trigger) and the actual driving of the fastener. The at least one low friction guide bushing is a guide material used on at least one of the extensible polymer assembly and/or the fastener drive assembly such that the coefficient of dynamic friction is less than 0.3 between such assembly and the guide structure. The mechanical element is a device such as a lost motion coupling, sear or trip lever, which releases the fastener drive assembly from the retention means based on the positioning of the extensible polymer assembly.

During a drive cycle, the linear motion converter converts the rotational motion of the motor into linear motion, which linear motion is used to actuate the extensible polymer assembly. Once actuated, the extensible polymer assembly moves from a first position to a second position and stores energy in the polymer which is operatively coupled to both the extensible polymer assembly and the fastener drive assembly. The fastener drive assembly, which is retained in the first position by the retention means, remains in the first position until sufficient energy is stored in the polymer, at which point the fastener drive assembly can be released from the retention means. (It will be apparent that the fastener drive assembly may be released from the retention means mechanically through a trip lever, sear or lost motion coupling, or electrically by deactivating an electromagnet, where the electromagnet is the retention means or activating or deactivating a solenoid where a solenoid is part of the retention means.) The fastener drive assembly uses the potential energy in the polymer to move from the first position to the second position, which accordingly causes the anvil to move from and to the same. As the anvil moves from a first position to a second position, it will come into contact with the head of a fastener and will transfer the energy of the polymer to such fastener in order to drive it into a substrate. In an embodiment, the linear motion converter may thereafter actuate the extensible polymer assembly in order to move the extensible polymer assembly from the second position to the first position, which movement thereof may resultingly cause the fastener drive assembly to similarly return to the first position. This would have the effect of returning the various components of the fastener driving apparatus to their initial positions such that the drive cycle may be operatively repeated.

Referring now to FIGS. 1 through 5, and in an exemplary embodiment, the drive cycle of the fastener driving apparatus 30 is initiated by the user pressing a trigger switch 15 that causes power to be directed from the power source 31 to the motor 1 through the control circuit 10. The user will preferably hold the apparatus 30 by the hand grip 2 in order to avoid safety issues during operation. The control circuit 10 may be any device capable of transmitting power to the motor 1 for the purpose of initiating a drive cycle and then removing the power to the motor 1 after the drive cycle has substantially completed. Directing power to the motor 1 causes it to turn, transferring energy through the rotating elements thereof and into the linear motion converter 5. The linear motion converter 5 is operatively coupled to the motor 1 and to the extensible polymer assembly 8, and may be any mechanism capable of converting the rotational motion of the motor 1 into a linear motion for use with the extensible polymer assembly 8. In an embodiment, the linear motion converter 5 comprises one of a slider crank, rack and pinion, friction drive, belt drive, screw drive, and cable drive, with the preferred embodiment being a rack and pinion. A gear reducer 3 is included, which reduces the speed of the rotational motion outputted by the motor 1 to a speed at which the linear motion converter 5 may operate. In one embodiment, a clutch may be included as one of the elements of the linear motion converter. In such an embodiment, the clutch may be used to actively engage and disengage the motor from the linear motion converter, thus reducing the latency in the fastener driving device.

Figure 2:
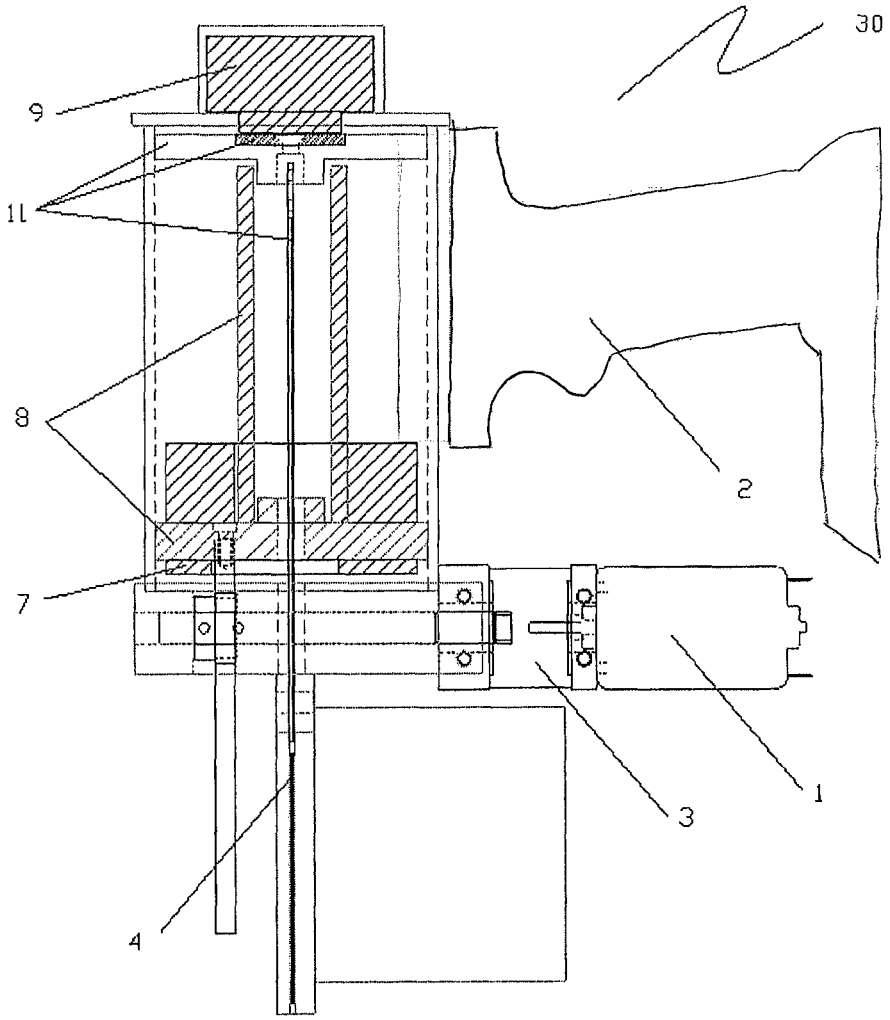
FIG. 2 shows a cutaway view of a fastener driving apparatus showing the extensible polymer assembly in the stretched position with energy stored in accordance with an exemplary embodiment of the present disclosure.

As shown in FIG. 2, the linear motion converter 5 moves the extensible polymer assembly 8 away from the fastener drive assembly 11, thereby resulting in energy being stored within the polymer contained in the extensible polymer assembly. The motor 1 may thereafter continue to rotate, which rotation further moves the extensible polymer assembly 8 until, in an embodiment, it is approximately at a bottom dead center position (hereinafter referred to as "BDC") within the guide assembly 6. Once this occurs, the energy stored in the polymer within the extensible polymer assembly will be at or near a maximum level. In an embodiment, the extensible polymer assembly is predisposed between the fastener drive assembly and the linear motion converter, both of which fastener drive assembly and linear motion converter are predisposed inside the guide assembly. It will be apparent that other structural and operational configurations are also possible. The polymer has a weight and structure that is proportional to the amount of work to be done. For example, where the fastener to be driven is a 16 gauge finish nail, the polymer can be an isoprene cylinder 1" in un-stretched length with an inner diameter of 1" and an outer diameter of 1.5". This cylinder when stretched to 350% of its initial length results in about 300 inch lbs. of drive energy for the fastener.

Figure 3:
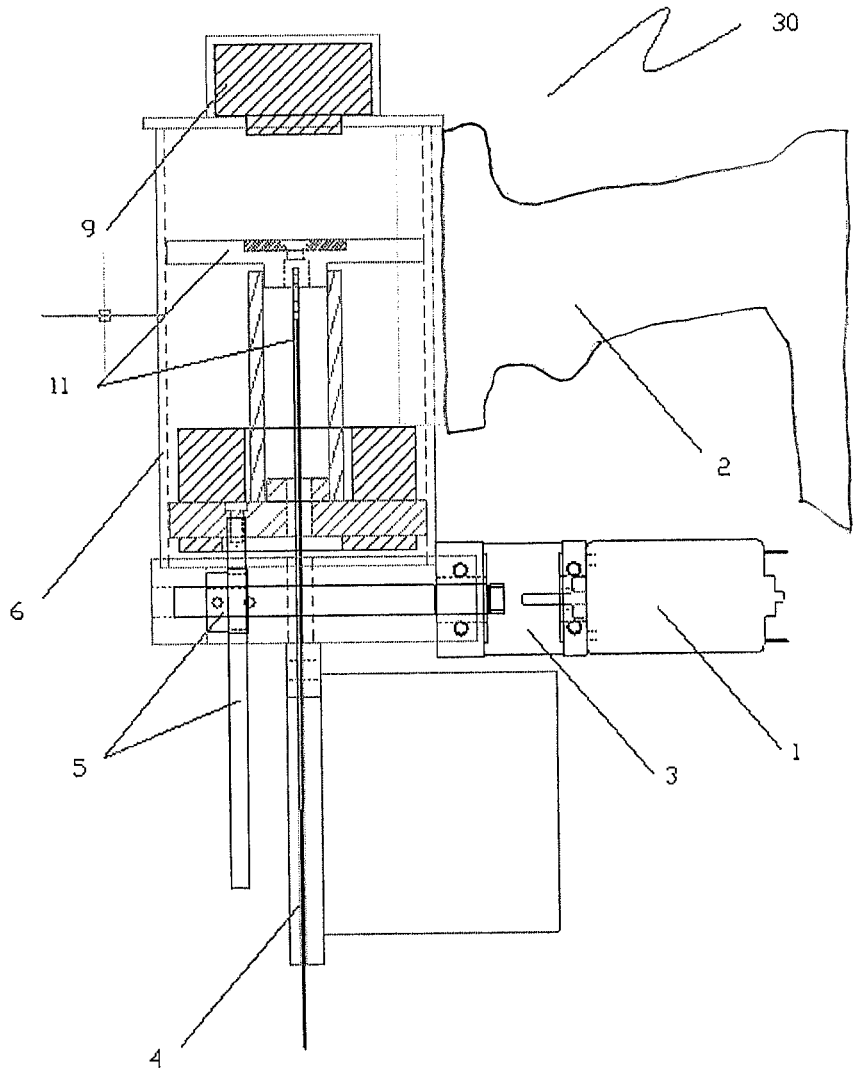
FIG. 3 shows a cutaway view of a fastener driving apparatus showing the fastener drive assembly being mechanically released and the fastener being driven into the substrate in accordance with an exemplary embodiment of the present disclosure.
Figure 4:
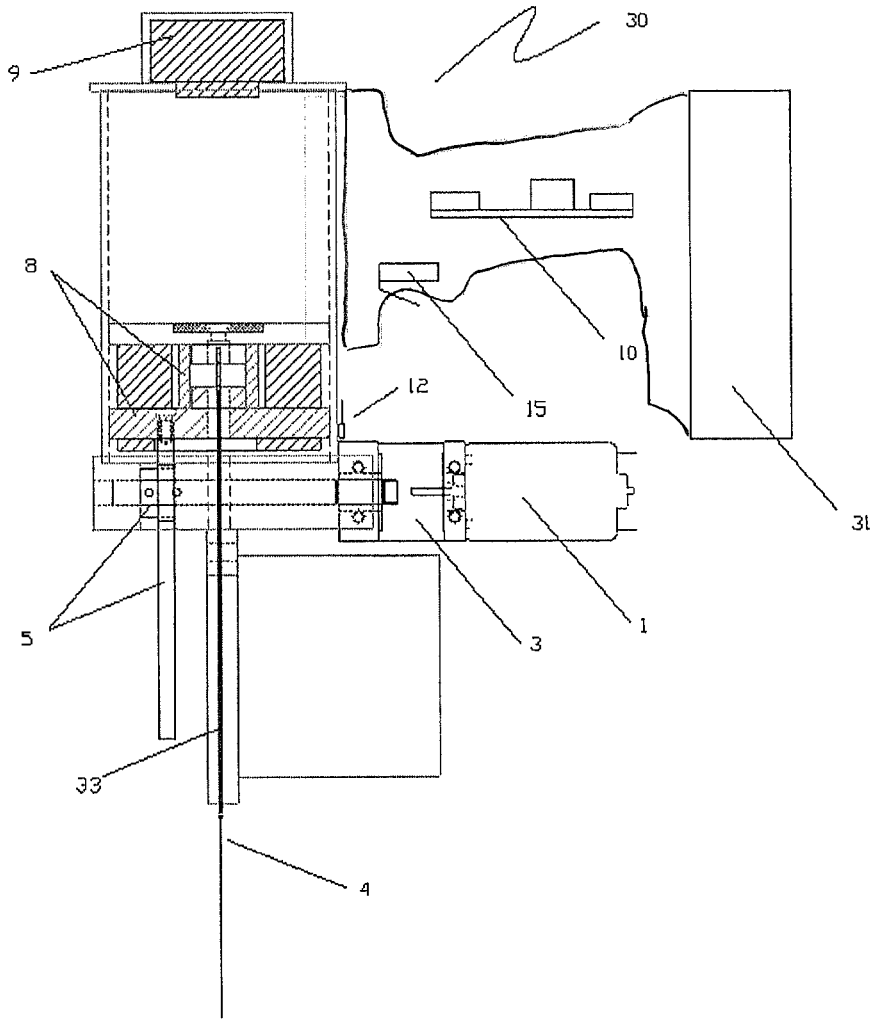
FIG. 4 shows a cutaway view of a fastener driving apparatus, in accordance with an exemplary embodiment of the present disclosure showing the fastener fully driven.

The fastener drive assembly 11 is held in place by a retention means 9 (as shown in FIG. 3) until the polymer has reached a sufficient extension, or after the retention means 9 ceases applying a retention force on the fastener drive assembly 11, or when another force acts to overcome the retention force. As an example, the fastener drive assembly may comprise a pin or other contact point for the extensible polymer assembly 8 to contact near BDC of the extensible polymer assembly such that the contact force in addition to the force of the extensible polymer assembly exceeds the retention force. In an embodiment, the retention means 9 is at least one of a magnet, electromagnet, solenoid, mechanical means (including, for example, detents and levers), pneumatic valve, and friction fit. In an embodiment wherein the retention means 9 is a magnet, the fastener drive assembly 11 may include a ferrous element that allows the fastener drive assembly 11 to be retained by a magnet force, and, for the release, the magnetic force from retention means 9 is overcome by a force from the extensible polymer assembly 8. In an embodiment where the fastener drive assembly is coupled to another element such as an anvil, the retention means can act on the anvil, for example, in order to retain the fastener drive assembly.

In an embodiment, the retention means 9 may retain the fastener drive assembly 11 in the first position until the extensible polymer assembly reaches a certain stretch. In a preferred embodiment a dwell in the linear motion converter occurs in one or more of the ends of the extensible polymer assembly stroke. A dwell at or near BDC allows for the fastener drive assembly to finish the fastener drive stroke without impacting the extensible polymer assembly on its return stroke. A dwell at or near a top dead center position (hereinafter referred to as "TDC") allows time for the polymer to recover to its initial un-stretched length.

The fastener drive assembly 11 is operatively coupled to an anvil 33, which anvil 33 comes into contact with and drives the fastener 4. As stated above, once the polymer in the extensible storage apparatus has reached a particular percentage of stretch, the retention means 9 is released or overcome, which release applies the potential energy stored in the polymer onto the fastener drive assembly 11 such that the fastener drive assembly 11 and anvil 33 are moved downward towards BDC. This movement results in the anvil 33 coming into contact with the head of the fastener 4, thus transmitting the energy to the fastener 4, thereby causing it to be driven into the substrate. In an embodiment, and once the fastener 4 is driven, a new fastener 4 may be loaded into the apparatus 30 from an attached nail magazine 14.

It should be noted that the fastener drive assembly 11 and anvil 33 that drives the fastener 4 into the substrate do not compress any type of anvil return spring during the drive cycle. While it was expected that this would result in an improvement to the apparatus 30, the degree of improvement was unexpected. Heretofore in the prior art, the air spring and mechanical spring designs would bias the anvil away from the substrate and rob energy during the drive cycle. The improvement herein not only results from no loss of force during the drive cycle, but also from an increased drive speed, as no return spring or bungee is coupled to the fastener drive assembly 11. Furthermore, the absence of a return spring simplifies jam recovery in that if the anvil 33 jams during a down stroke of the drive cycle, the return stroke of the extensible polymer assembly 8 retracts the anvil 33 and clears the jam. This automatically resets the timing and readies the device 30 for the next drive cycle.

Figure 5:
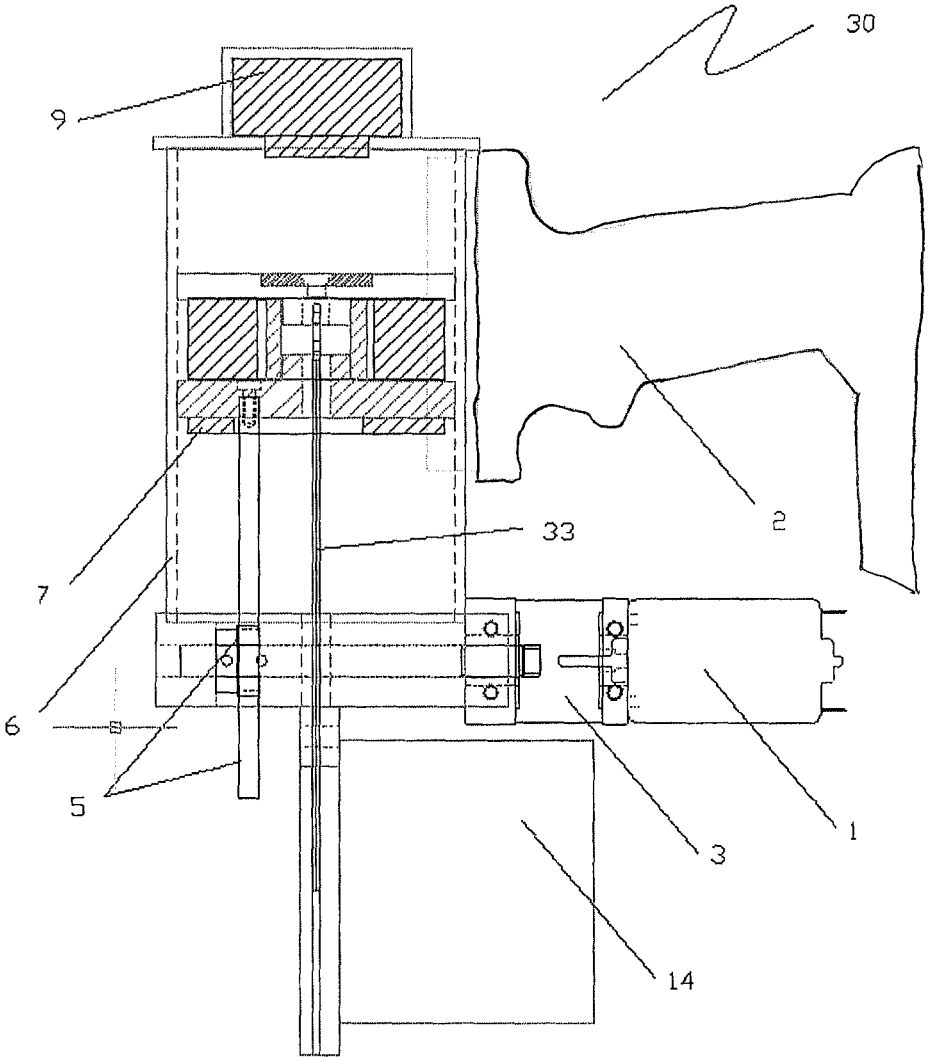
FIG. 5 shows a cutaway view of a fastener driving apparatus, in accordance with an exemplary embodiment of the present disclosure showing the extensible polymer assembly returning to an initial position and contacting the fastener drive assembly and moving said fastener drive assembly to an initial position as well.
Figure 6:
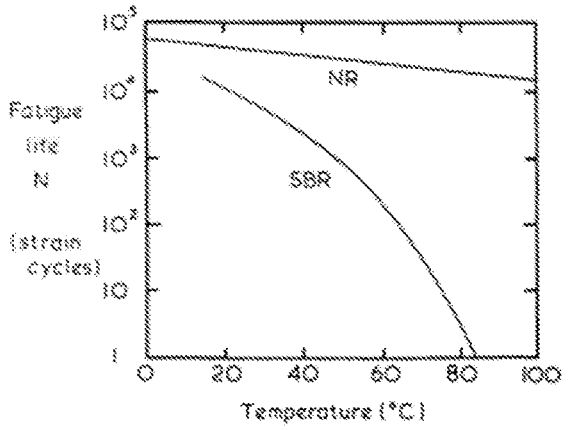
FIG. 6 shows a fatigue diagram of an exemplary extensible polymer compatible with the present invention.

In a preferred embodiment, the drive cycle is followed by a return cycle (as shown in FIG. 5, for example), which involves the extensible polymer assembly 8 moving from BDC and beginning its upward stroke. The upward stroke may be initiated by reversing the direction of the motor 1, which, in a preferred embodiment, is accomplished via a rack and pinion linear motion converter 5. In a further embodiment, the motor is a brushless motor, which minimizes the energy which is lost in motor reversal by limiting the energy stored in the rotor inertia. This upward stroke causes the extensible polymer assembly 8 to come into contact with the fastener drive assembly 11 and effectively returns the fastener drive assembly 11 back to its exemplary starting position at or near a TDC position where the fastener drive assembly 11 can be retained by the retention means 9 and prepare for another drive cycle.

Once the return cycle has completed, the operation of the apparatus 30 may be halted, and the power source 31 may be operatively disconnected from the control circuit 10 and/or the motor 1 dynamically braked. At this point, the apparatus 30 is ready to repeat the drive cycle. In a preferred embodiment, a sensor 12 is used to determine when the fastener drive assembly 11 is at or near TDC to allow for the drive cycle to be repeated. Although the extensible polymer assembly 8 is not similarly required to return to TDC, the extensible polymer assembly 8 may preferably stop movement approximately between BDC and TDC in order to prepare for the next drive cycle. In the embodiment wherein the apparatus 30 comprises a sensor 12, the sensor 12 may be further used to determine when the extensible polymer assembly 8 has reached a particular position. In an embodiment, the remainder of the movement of the extensible polymer apparatus 8 towards TDC may occur at the initiation of the next drive cycle.

In another embodiment, the apparatus 30 further comprises a bumper 7 disposed between the extensible polymer assembly 8 and the fastener drive assembly 11. The bumper 7 absorbs excess energy after the completion of the drive cycle or the return cycle, thereby preventing that energy from being transmitted to another component of the apparatus 30. Namely, the bumper 7 prevents the remaining force from causing the extensible polymer assembly 8 and the fastener drive assembly 11 to damagingly contact one another. In an embodiment, more than one bumper 7 may be used as described for added force absorption and protection of the various components.

In a preferred embodiment the fastener drive assembly comprises at least one guide bushing for engagement with the guide assembly. In a further preferred embodiment, one or more of the guide bushings used in the fastener drive assembly comprises a low friction material. Through development, it was determined that the drag losses were a major contributor to inefficiencies of fastener driving devices and were a function of the interface pressure and the coefficient of friction between the fastener drive assembly and the guide structure. A preferred design uses a composite Teflon graphite material backed up by a spring loading mechanism. The spring ensures that a low but consistent force is exerted between the fastener drive assembly and the guide structure (such as a wall of the guide structure) thus ensuring accurate guiding and the Teflon graphite composite material ensures a low wearing material with a low coefficient of friction.

Figure 7:
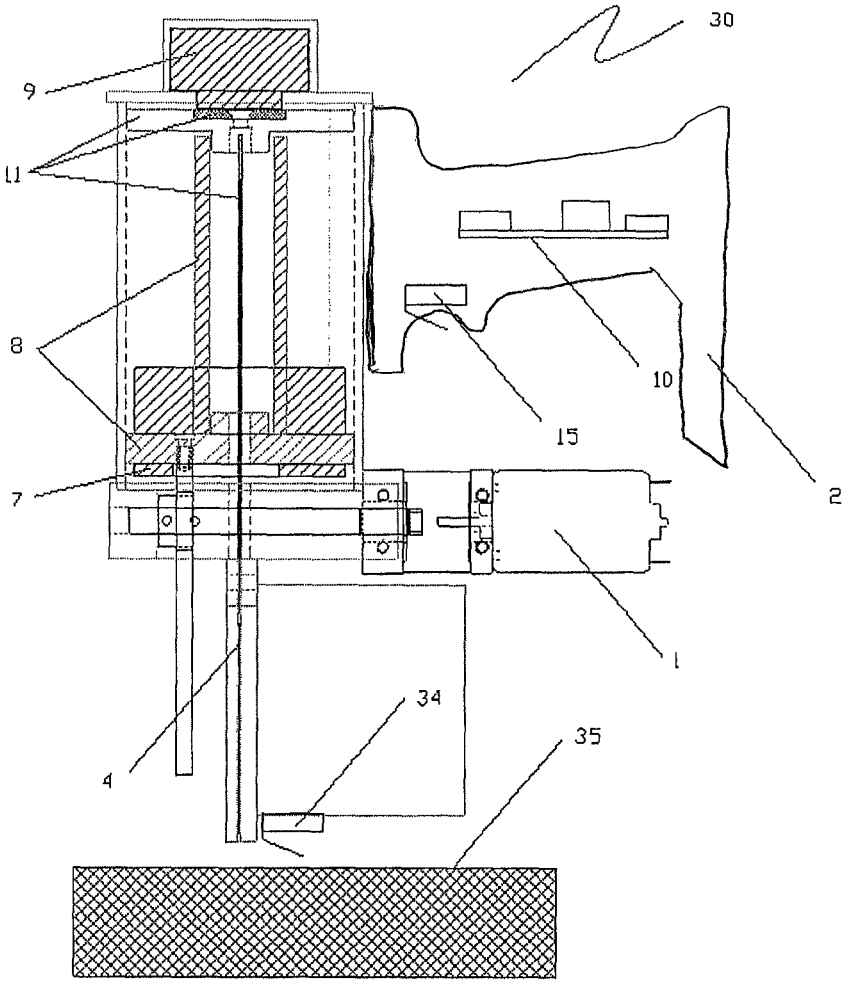
FIG. 7 shows a cutaway view of a fastener driving apparatus, in accordance with an exemplary embodiment of the present disclosure showing the extensible polymer assembly stopping at an intermediate position for reducing latency.

Referring now to FIG. 7 and in a further embodiment an intermediate stopping point is used in the fastener driving device. This preferred embodiment stops and holds the extensible polymer assembly at an intermediate point that corresponds to preferably at least 50% of the cycle stroke. The purpose of such an intermediate stopping point is to allow reduction in the system latency of at least 50%. In FIG. 7, the extensible polymer assembly is shown held at such a position. One exemplary operation in this embodiment is in the standard bump fire mode in which the operator presses a trigger causing the extensible polymer assembly to come to this intermediate point and stop. The operator can use the contact trip 34 to "bump" against the substrate 35 and engage bump fire, causing the extensible polymer assembly and fastener drive assembly to complete the normal stroke thus reducing the latency in the fastener driving mechanism by at least 50%.

In a further embodiment, one or more fault conditions may be detectable by the control circuit 10 and/or sensors 12. Where one or more of the control circuit 10 and/or sensors 12 have failed, the apparatus 30 may be safely shut down and operation thereof may be inhibited until the detected fault is corrected. A fault condition is defined as any condition in which the apparatus 30 could operate without all safety conditions being met. The safety conditions may include the contact trip on the foot of the apparatus 30 as well as the trigger switch for cycle initiation.

In a still further embodiment, it is known that polymers which undergo repeated stretch and relaxation cycles end up damaging the polymer chains and taking a permanent set. (An increase in the length of the polymer in its relaxed state). The fastener driving device has a compensatory mechanism which allows for the user to maximize life from the device by allowing for a set of up to 20% of the initial length of the polymer. In a preferred embodiment, this can be done by adjusting the release point of the fastener driving assembly and or the depth of drive.

Although the aforementioned elements are used in the preferred design, it is understood by those familiar with the art that considerable simplification is possible without departing from the spirit of the invention. It is further understood by those skilled in the art that the sensors 12 can be used in conjunction with other elements of the control circuit 10 to allow location at different places, and that sensors 12 can be of many forms including, but not limited to, limit switches, Hall effect sensors, photo sensors, reed switches, timers, and current or voltage sensors, without departing from the spirit of disclosure. Further, preferred embodiments of the control circuit 10 include, but are not limited to, low battery indication, pulse-width modulation control of motor, status display, and sequential or bump fire.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus for driving a fastener into a substrate, the apparatus comprising:

a power source;

a control circuit, said control circuit operatively coupled to said power source;

a motor, said motor operatively coupled to said power source, said motor responsive to said control circuit;

an extensible polymer assembly;

said extensible polymer assembly comprising at least one extensible polymer;

a linear motion converter, said linear motion converter operatively coupled to said motor, said linear motion converter operatively coupled to said extensible polymer assembly;

a fastener drive assembly;

an anvil, said anvil operatively coupled to said fastener drive assembly;

a retention means, said retention means retaining said fastener drive assembly in a first position until a sufficient force is applied against said retention means or until a retention force of said retention means is released; and a guide structure, said extensible polymer assembly capable of reciprocally moving within said guide structure, said fastener drive assembly capable of reciprocally moving within said guide structure, wherein during a drive cycle said linear motion converter actuates said extensible polymer assembly such that energy is stored as said extensible polymer of said extensible polymer assembly extends in length and force from said extensible polymer is applied on said fastener drive assembly, and when said extensible polymer reaches a sufficient extension, said retention means releases said fastener drive assembly and wherein said fastener drive assembly moves from a first position to a second position such that said anvil is capable of driving a fastener into a substrate.

2. The apparatus as claimed in claim 1, wherein said extensible polymer of said extensible polymer assembly is one of an elastomer or a rubber that is extended at least 75%.

3. The apparatus as claimed in claim 1, wherein said retention means comprises at least one of a magnet, electromagnet, solenoid, mechanical means, pneumatic valve, mechanical restraint and friction fit.

4. The apparatus as claimed in claim 1, wherein said apparatus further comprises a timed dwell at or about the top and or bottom of the stroke of the extensible polymer assembly.

5. The apparatus as claimed in claim 1 wherein said apparatus comprises a fan, said fan capable of providing convective air flow to cool said extensible polymer of said extensible polymer assembly.

6. The apparatus as claimed in claim 1, wherein at least one bumper is disposed between said extensible polymer assembly and said fastener drive assembly to absorb excess energy and prevent damage to the fastener drive apparatus.

7. The apparatus as claimed in claim 1, wherein said extensible polymer of said extensible polymer assembly has a minimum fatigue life of 10000 cycles when operated at an engineering strain of 1.

8. The apparatus as claimed in claim 1, wherein said linear motion converter comprises at least a clutch, overload clutch or gear reduction.

9. The apparatus as claimed in claim 1, wherein said apparatus further comprises a mechanical element, which mechanical element is capable of releasing said fastener drive assembly from said retention means based on a position of said extensible polymer assembly in said guide structure.

10. The apparatus as claimed in claim 1, wherein said control circuit precludes the further operation of the apparatus upon the detection of a fault condition until the fault condition has been resolved.

11. The apparatus as claimed in claim 1, wherein said extensible polymer assembly has an intermediate stopping point that is preferably greater than 50% of full extension.

12. A fastener driving apparatus for driving a fastener into a substrate, the apparatus comprising:

a power source;

a control circuit, said control circuit operatively coupled to said power source;

a motor, said motor operatively coupled to said power source, said motor responsive to said control circuit;

an extensible polymer assembly;

said extensible polymer assembly comprising at least one extensible polymer;

a linear motion converter, said linear motion converter operatively coupled to said motor, said linear motion converter operatively coupled to said extensible polymer assembly;

a fastener drive assembly;

an anvil, said anvil operatively coupled to said fastener drive assembly;

a retention means, said retention means retaining said fastener drive assembly in a first position until a sufficient force is applied against said retention means or until a retention force of said retention means is released; and a sensor, said sensor capable of determining at least one position of the extensible polymer assembly or fastener drive assembly wherein during a drive cycle said linear motion converter actuates said extensible polymer assembly such that energy is stored as the extensible polymer of said extensible polymer assembly extends in length and force from said extensible polymer is applied on said fastener drive assembly, and when said extensible polymer reaches a sufficient extension, said retention means releases said fastener drive assembly and wherein said fastener drive assembly moves from a first position to a second position such that said anvil is capable of driving a fastener into a substrate and wherein the at least one sensor provides a signal to the control circuit to stop the cycle.

13. The apparatus as claimed in claim 12, wherein said linear motion converter comprises at least a clutch, overload clutch or gear reduction.

14. The apparatus as claimed in claim 12 wherein said apparatus further comprises a mechanical element, which mechanical element is capable of releasing said fastener drive assembly from said retention means based on a position of said extensible polymer assembly in said guide structure.

15. The apparatus as claimed in claim 12, wherein said control circuit precludes the further operation of the apparatus upon the detection of a fault condition until the fault condition has been resolved.

16. The apparatus as claimed in claim 12, wherein said extensible polymer assembly has an intermediate stoppage point that is preferably greater than 50% of full extension.

17. A fastener driving apparatus for driving a fastener into a substrate, the apparatus comprising:

a power source;

a control circuit, said control circuit operatively coupled to said power source;

a motor, said motor operatively coupled to said power source, said motor responsive to said control circuit;

an extensible polymer assembly;

said extensible polymer assembly comprising at least one extensible polymer;

a linear motion converter, said linear motion converter operatively coupled to said motor, said linear motion converter operatively coupled to said extensible polymer;

a fastener drive assembly;

an anvil, said anvil operatively coupled to said fastener drive assembly;

a retention means, said retention means retaining said fastener drive assembly in a first position until a sufficient force is applied against said retention means or until a retention force of said retention means is released; and a compensatory mechanism allowing adjustment of up to 20% of initial length of said extensible polymer of said extensible polymer assembly wherein during a drive cycle said linear motion converter actuates said extensible polymer assembly such that energy is stored in said extensible polymer as said extensible polymer assembly extends in length and force from said extensible polymer of said extensible polymer assembly is applied on said fastener drive assembly, and when said extensible polymer of said extensible polymer assembly reaches a sufficient extension, said retention means releases said fastener drive assembly and wherein said fastener drive assembly moves from a first position to a second position such that said anvil is capable of driving a fastener into a substrate.

18. The apparatus as claimed in claim 17, wherein said extensible polymer of said extensible polymer assembly is one of an elastomer or a rubber that is extended at least 75%.

19. The apparatus as claimed in claim 17, wherein said retention means comprises at least one of a magnet, electromagnet, solenoid, mechanical means, pneumatic valve, mechanical restraint and friction fit.

20. The apparatus as claimed in claim 17, wherein said apparatus further comprises a timed dwell at or about the top and or bottom of the stroke of the extensible polymer assembly.

* * * * *